United States Patent [19]

Homann et al.

[11] 4,024,168

[45] May 17, 1977

[54] METHOD OF EXTRACTING OILS FROM FRUITS SUCH AS SEEDS NUTS AND BEANS

[75] Inventors: Thorsten Homann, Hamburg; Felix Horst Schneider, Essen; Dietmar Weber, Hamburg, all of Germany

[73] Assignee: Fried. Krupp Gesellschaft mit beschrankter Haftung, Essen, Germany

[22] Filed: July 9, 1974

[21] Appl. No.: 486,825

[30] Foreign Application Priority Data

July 12, 1973 Germany ..... 2335385

[52] U.S. Cl. ..... 260/412.2; 100/37; 100/93 S; 100/117; 260/412.4

[51] Int. Cl.² ..... C11B 1/00; C11B 1/08; B30B 9/14

[58] Field of Search ..... 260/412.2, 412; 426/489; 100/145, 148, 150, 117, 37, 93 S

[56] References Cited

UNITED STATES PATENTS

| | | | |
|---|---|---|---|
| 639,529 | 12/1899 | Cook | 260/412.2 |
| 1,640,342 | 8/1927 | Anderson | 100/145 |
| 1,709,349 | 4/1929 | Hollstein | 100/148 |
| 2,466,492 | 4/1949 | Sizer | 100/150 |
| 2,556,499 | 6/1951 | Killip | 100/145 |
| 3,273,495 | 9/1966 | Ozawa | 100/145 |
| 3,518,936 | 7/1970 | Bredeson | 100/148 |
| 3,814,566 | 6/1974 | Stroup | 425/144 |
| 3,939,763 | 2/1976 | Sato | 100/117 |

FOREIGN PATENTS OR APPLICATIONS

| | | | |
|---|---|---|---|
| 569,347 | 7/1958 | Belgium | 260/412.2 |
| 883,051 | 11/1961 | United Kingdom | 252/412.6 |
| 4,661 | 5/1911 | United Kingdom | 260/412.2 |

*Primary Examiner*—Winston A. Douglas
*Assistant Examiner*—P. E. Konopka
*Attorney, Agent, or Firm*—Karl F. Ross; Herbert Dubno

[57] ABSTRACT

Fruits, such as nuts and the like, are loaded at an inlet end into an elongated housing having a passage provided with a rotatable screw. At the end adjacent the inlet the screw serves to crush and thoroughly comminute the fruit so that the oil therefrom can be drawn off through strainers. The screw is formed with a thread having gaps which receive flow-interruptors which project inwardly from the housing and which insure complete mixing of the crushed fruit. In addition the screw is formed with a ridge defining a narrow gap with the inner wall of the housing so that no large particles can be left in the finished product. The screw also has a region of lesser diameter where the crushed fruit is degassed by withdrawal of air and vapor through the wall of the housing. The housing and the screw are heated so that as the fruit is being crushed and the oil extracted this fruit is roasted. At the downstream end the paste-like pulp of the fruit is extruded.

1 Claim, 15 Drawing Figures

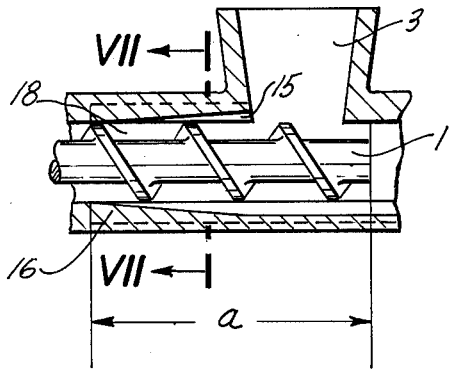
FIG. 6
FIG. 7
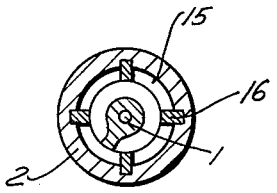
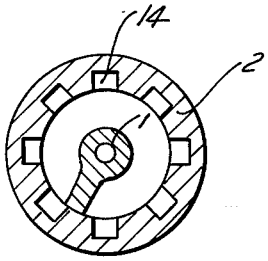
FIG. 8
FIG. 9
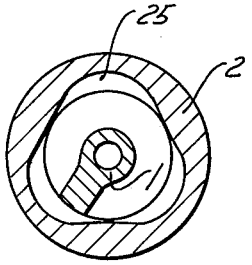

METHOD OF EXTRACTING OILS FROM FRUITS SUCH AS SEEDS NUTS AND BEANS

FIELD OF THE INVENTION

The present relates to a method of extracting oil from fruit. More particularly this invention concerns an oil extracting system for soybeans, peanuts, cocoanuts, and the like.

BACKGROUND OF THE INVENTION

In the extraction of oil from fruit such as nuts, seeds, and the like it is necessary to comminute the fruits completely, thereby destroying the cell wall which retained the oil. This is done in a two-stage process: first the fruits are crushed, then the crushed fruits are heated. These two steps are always carried out regardless of the stage at which the oil is extracted. Sometimes the oil is extracted at the crushing press, and sometimes it is extracted from the heated crushed pulp by means of a solvent.

As a general rule the first step, that is comminuting or crushing the oil fruit, is carried out by means of crushing rollers. These rollers are ridged and the oil fruits are passed through them several times, or are passed through several pairs of such rollers. Finally, the crushed fruits are passed between a pair of smooth rollers which squeeze the mass of granulates together. The rolls generally are set at a gap of 0.2 mm in order to ensure that the cell walls of the fruits are completely destroyed. This close spacing has the considerable disadvantage that should any sand or other abrasive particles find their way into the process, the rollers become worn. In practice rollers rapidly wear out at their central regions so that after only a relatively short service life they must be removed and turned down.

The thermal treatment generally takes place in large pans which are loaded into an oven in levels from 400 to 700 mm apart. It is common practice to provide agitating or mixing elements which ensure that the entire crushed mass is properly roasted. Such a roasting process is relatively lengthy as the crushed mass itself is a good insulator and requires a very long time to heat up fully. Should the extraction process break down somewhere along the way it is necessary to finish roasting the batch in process before the oven too can be shut down. Another difficulty with these ovens is that they are generally of gas type, requiring air circulation over the mass being heated so that much of the oil is lost in the form of vapor while the time necessary to heat the crushed nuts and seeds is again increased.

The principal difficulty with the hitherto known system is that it requires a great detail of expensive equipment which takes up much floor space. The process is not very efficient and is relatively costly in terms of the energy required to produce a given quantity of oil. Of course with the proliferation of different pieces of equipment the possibility of breakdown and the severity of the consequences thereof increases.

OBJECTS OF THE INVENTION

It is therefore an object of the present invention to provide an improved method of extracting oil from oil fruits.

Yet another object is the provision of a system for extracting oil from oil fruits which is relatively simple and inexpensive.

A further object is to provide an oil-extraction system which has a high efficiency so as to extract virtually all the oil from nuts or the like.

SUMMARY OF THE INVENTION

These objects are attained according to the present invention in a system where the oil fruits are simultaneously heated and comminuted substantially in the absence of air flow through or over them. Thus the complicated process is reduced to a single continuous operation with the cleaned raw fruits being loaded at one end and thermally treated pulp being expelled at the other end. Thus soybeans, coconuts, husked peanuts, or the like which are free of foreign matter and which can be pre-broken are loaded into the machine according to the present invention either at room temperature or preheated, and even in a wet condition if desired, as this additional water is beneficial in the roasting process.

The machine in accordance with the present invention comprises a hollow housing having an input end and an output end and provided with a rotatable screw extending between these ends so that on rotation of this screw the fruits are advanced from the input to the output. Means is provided to heat the fruit in the housing by heating the screw and/or the housing. The housing is subdivided into a plurality of zones each of which can be heated to a different temperature for optimum thermal treatment of the fruits.

The mechanical conditioning of the fruits comprises a comminution of them by cutting them into smaller pieces and crushing them. This is carried out both by the rubbing of the fruits against the screw and against the housing, as well as the rubbing of the comminuted fragments against one another. Such an extrusion process is indeed capable of reducing even relatively hard objects such as coconuts to a fluid paste which is extruded at the output end in the form of a strand.

In accordance with yet another feature of this invention, the screw is provided with a ridge distinct from its screw thread. This ridge may be circumferential and endless, lying in a plane perpendicular to the rotation axis of the screw or it may itself be formed helically as a screw thread having a substantially greater pitch than the flights of the adjacent screw thread on the screw. The comminuted mass must be pumped over this ridge and is thereby mixed and reduced to a very fine consistency so that no whole, oil-containing cells are left. The material is subjected to high pressure as it passes over this ridge so that shear forces in the flow direction caused by this pressure as well as shear forces radial to the rotation axis of the screw due to the relative motion between the ridge and the cylinder walls act together to comminute the fruit very effectively. In addition with such a restricting ridge, when arranged at an angle to the longitudinal axis of the screw, that is when running as a thread between the flights of the main screw thread, the resistance to longitudinal flow in the housing is reduced to a minimum.

Flow-interrupting elements are provided which project from the inner walls of the housing into the screw-receiving passage. These elements serve to mix the helical strand of crushed fruits which is being advanced by the screw from the input end to the output end, and increase the overall throughput speed of the machine. This latter effect is due to the operation of these elements in mixing the flow and preventing oil driven out of the fruit from collecting on the inner wall of the housing and the screw and thereby lubricating the strand of crushed fruit such that it slips and is not advanced by the screw. The screw thread is interrupted at each of these flow-interrupting elements and each of these elements is in accordance with this invention formed with a throughgoing passage opening immediately adjacent the surface of the screw so that oil can be withdrawn from the housing through these elements.

According to further features of this invention the passage in the housing is divided into several zones. The zone immediately adjacent the input end is tapered away from this end so as to compress the fruit. This is effected by forming tapered grooves in the wall of the cylindrical passage.

In accordance with yet another feature of this invention there is provided at the input end of the housing at least one strainer such as a rod strainer, a hole strainer, or a laminate strainer which allows oil squeezed out of the fruit by the crushing process to be drawn off.

According to the present invention downstream of this entry zone there is a low-pressure zone wherein the screw is formed with a relatively deep screw thread and a relatively large pitch. A vacuum pump is connected to the interior of the housing at this location so as to vaporize and draw off liquid in the fruit. It is also possible in this region to introduce a liquid such as water into the crushed fruit so as to facilitate later operations.

It should be noted that in a closed system in accordance with this invention there is practically no oxidation of the fruit as it is crushed and at the same time the compacted fruit in contact with the heated screw and housing walls is rapidly brought to the desired temperature. The intensive mechanical mixing of the crushed fruit as it passes along the treatment passage also insures that every particle will be brought to the desired temperature rapidly. The mass of crushed fruit once it is ejected at the downstream end of the machine expands due to difference in pressures inside and outside the machine so that vapor in the mass condenses, thereby making it relatively easy to extract any remaining oil in this pulp by rinsing it out, since the pulp is already slightly wet.

Clearly the apparatus in accordance with the present invention is relatively simple and is capable of rapidly and efficiently comminuting and thermally treating nuts and the like. In addition it can be used for the gasoline or benzine extraction of such oil fruits. The treatment is complete and can be controlled with very little difficulty. In addition the only part of the device which is likely to undergo wear is the screw of the extruder. Since only a single device is needed it is possible to treat a greater quantity of oil fruits within the same period. In addition the outlay for equipment is relatively low as a single machine as described above is capable of efficiently treating a great deal more raw product than would a machine of prior art-type of similar cost.

BRIEF DESCRIPTION OF THE DRAWING

The above and other objects, features, and advantages, will become more readily apparent through the following, reference being made to the accompanying drawing in which:

FIG. 6 is a detail of FIG. 2;

FIG. 7 is a section taken along line VII—VII of FIG. 6; and

FIGS. 8 and 9 are sections similar to FIG. 7 illustrating other arrangements in accordance with this invention.

SPECIFIC DESCRIPTION

Figure 1:
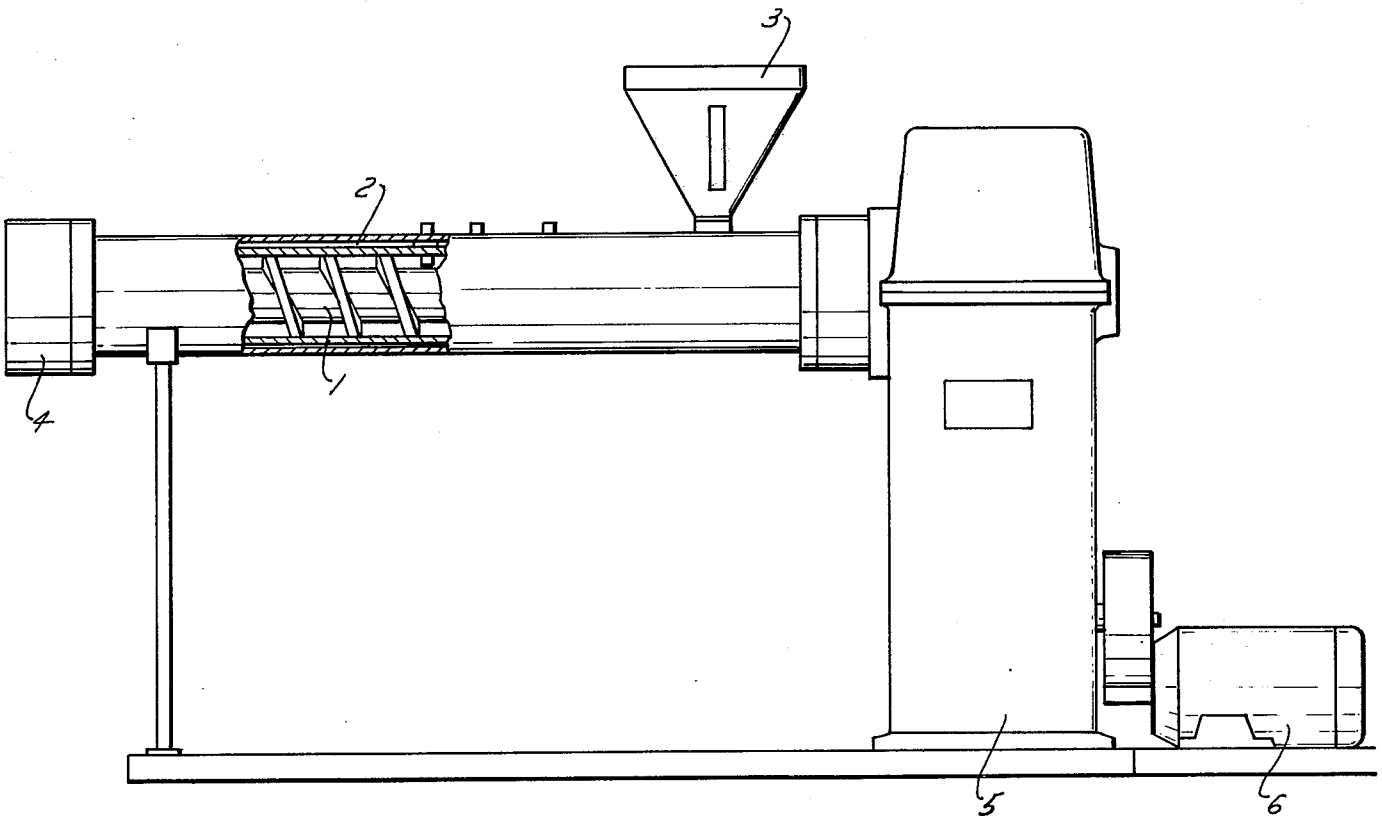
FIG. 1 is a side elevational view of the apparatus according to the present invention.

As shown in FIG. 1 the present invention basically comprises a screw 1 received within a housing 2 having an input hopper 3, and output end 4, and a drive transmission 5 connected to a drive motor 6.

Figure 2:
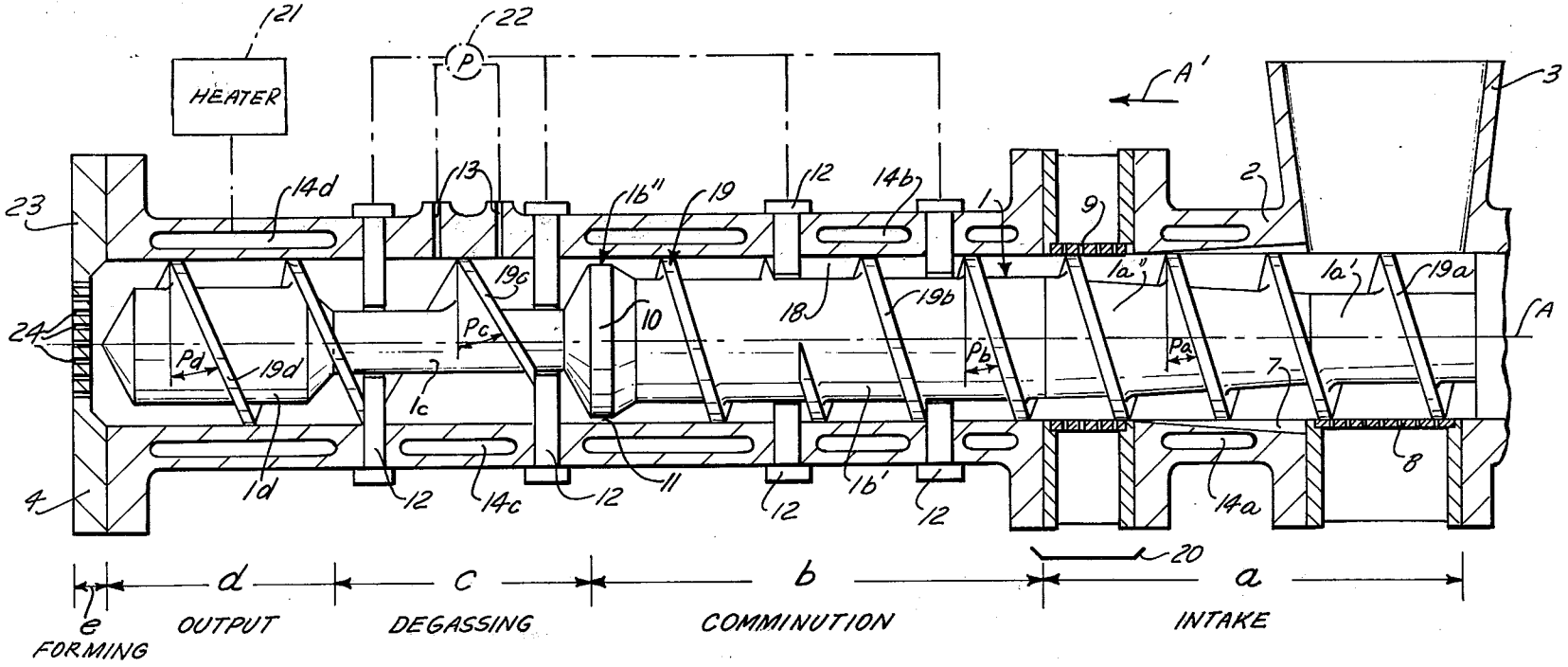
FIG. 2 is a longitudinal section through a portion of the apparatus of FIG. 1.

As shown more particularly in FIG. 2 the housing 2 is formed with a generally cylindrical passage 18 extending from the input 3 to the output 4. This passage 18 is subdivided into five zones *a–e* and the screw 1 is subdivided into six sections 1*a'*, 1*a''*, 1*b'*, 1*b''*, 1*c*, and 1*d*.

The inlet hopper 3 opens into the intake zone *a* above the first section 1*a'* of the screw. This section 1*a'* is of uniform inner diameter. Directly below the feed hopper 3 there is provided a strainer 8 so that oil issuing from nuts or the like broken open and crushed by the first section 1*a'* can be drawn off. Downstream of the section 1*a'* the screw section 1*a''* is of increasing inner diameter so that it is tapered toward the section 1*a'*. The section 19*a* of the screw thread 19 of the screw 1 is of the like uniform pitch Pa throughout the entire intake section *a*. The section 1*a''* serves augur-fashion to comminute and advance the fruit in the direction of arrow A'. Further oil draining from the partially crushed nuts and the like at the intake section *a* is drawn off at the downstream end thereof through a strainer 9 and collected in a vessel 20. The intake zone *a* is heated by stream passed by heater 21 through a chamber 14*a* formed in housing 2 at this zone *a*.

Figures 5A, 5B, 5C, 5D, 5E:
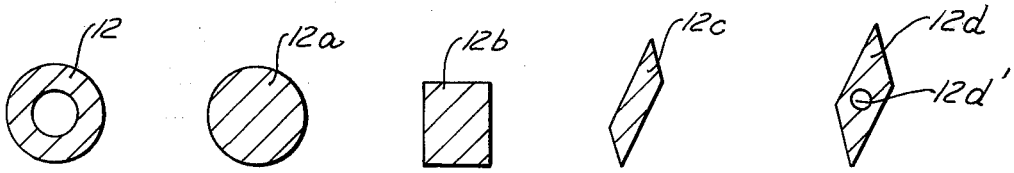
FIGS. 5A to 5E are sections of flow-interrupting elements

Downstream of the intake zone *a* there is provided a comminution or crushing zone *b* which is similarly heated by respective passages 14*b*. In this region the screw 1 is formed with a thread 19*b* continuing the thread 19*a* and having a pitch Pb equal to pitch Pa. This thread 19*b*, is, however, interrupted at two locations to clear four flow-interrupting elements 12 which are simple tubes extending radially of the axis A of the screw 1. A pump 22 is connected to these tabs 12, which are also shown in FIG. 5A so as to draw off oil at the surface of the screw 1.

Figure 3A:
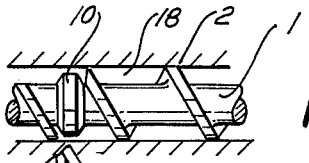
FIGS. 3A and 3B illustrate details of the arrangement of FIG. 2.
Figure 3B:
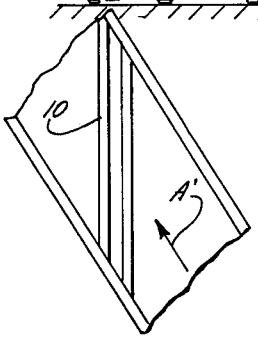

At the downstream end of *b* the section 1*b''* forms a ridge 10 lying in a plane perpendicular to the axis A and defining a narrow gap 11 with the inner wall of the housing 2. This ridge 10 is shown in more detail in FIGS. 3A and 3B where it can be seen that although it runs perpendicular to the axis A it is oblique to the direction A' of flow of crushed nuts in the passage 18. Passages 14*b* are provided in the wall of the housing 2 in zone *b* so as to allow this region to be heated also by steam from the heater 21.

Figure 4A:
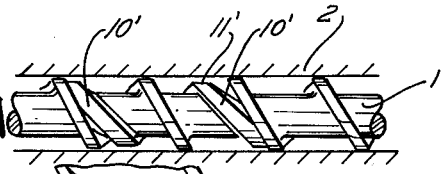
FIGS. 4A and 4B are views similar to view 3A and 3B respectively illustrating another arrangement in accordance with this invention.
Figure 4B:
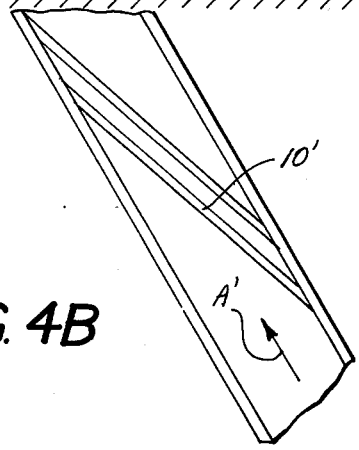

Instead of the ridge 10 it is possible as shown in FIGS. 4A and 4B to provide a ridge 10' which is formed as a thread of greater pitch than the thread 19*b* so that it lies at a small angle to the direction A'. This arrangement ensures that the resistance to flow offered by the ridge 10′ is reduced to a minimum. In both arrangements the function of the ridge 10 or 10′ is to insure complete comminution of the fruits or nuts by passage thereof through gap 11 or 11′.

It is also possible as shown in FIG. 5B, FIG. 5C, FIG. 5D and FIG. 5E to provide flow-interrupting elements 12*a*, 12*b*, 12*c* and 12*d*, respectively, which are round, square, rhombic, and rhombic with a thoroughgoing hole 12*d′* to interrupt the flow. The rhombic-section flow interrupters 12*c* and 12*d* are advantageous in that they also present minimum obstruction to flow with maximum mixing.

The comminuted fruit is degassed in zone *c* where the screw 1 has a section 1*c* which is of substantially lesser diameter than the upstream zones and has a thread 19*c* of pitch Pc which is substantially greater than the pitches Pa and Pb. Further flow-interrupting elements 12 are provided just inwardly of the upstream and downstream ends of the zone *c*, and the thread 19*a* is correspondingly interrupted. Throughgoing holes 13 are formed in the housing 2 at the zone *c* and are connected again to the pump 22 so that the zone *c* can be evacuated and virtually all of the liquid carried by the crushed fruit can be drawn off as vapor. This zone *c* is also heated by steam in passages 14*c*. Water as a solvent can also be introduced to the mass through the passages 13.

The decreased diameter of the section 1*c* insures that the crushed fruit will not be packed tightly in the zone *c*.

In zone *d* the screw 1*d* has a thread 19*d* of pitch Pd equal to pitches Pa and Pb. In addition the diameter of the section 1*d* is increased over that of section 1*c*, so that once again the comminuted pulp is compacted. In this zone also the passage 14*d* allows the pulp to be heated. At the extreme downstream end 4 of the housing 2 there is provided a forming zone *e* comprising a die plate 23 formed with a plurality of apertures 24 through which the now paste-like crushed fruit is forced as a plurality of strands. It is possible to take this paste and to further treat it with solvents or the like so as to extract any residual oil therein. The balance can be used as animal feed.

At its upstream end in the zone *a* the passage 18 is not cylindrical but is of conical section, tapered in the downstream direction. Vanes 16 are provided in this tapered region so as to form a plurality of downstream-tapered grooves 15 shown also in FIG. 7. It is possible within the scope of this invention to simply machine as shown in FIG. 8 a plurality of tapered grooves 14 for the same effect. Similarly FIG. 9 shows how the upstream end of the passage 18 can be of polygonal or lobular shape, here having three lobes 23. The function of such formations is to prevent blockages at the upstream end of the passage since the screw 1 in this region acts simply as an augur to precrush the material loaded into the hopper 3.

The apparatus according to the present invention serves to reduce fruits, such as nuts or the like, to a smooth paste, while extracting the oil from these fruits. A single piece of equipment is provided which within a relatively compact space thoroughly comminutes the fruits and extracts all of the oil therefrom, while at the same time thermally treating the pulp so as to prepare it for further use. The apparatus has a long service life and its operative parts, such as the flow interruptors and the screw are readily removable and renewable.

I claim:

1. A method of extracting oil from fruit comprising seeds, nuts or beans in a screw extruder in which a screw member is rotatable relatively to an elongated housing member and the screw member is provided with at least one screw flight extending helically therealong, said method comprising the steps of:

introducing the fruit into said extruder at an inlet, end thereof and displacing the fruit through said extruder by rotating said screw member whereby said flight forces the fruit toward an outlet end of said housing member;

comminuting the fruit in said extruder between said screw member and said housing member;

simultaneously with the comminution of said fruit between said members, heating said fruit by applying heat to at least one of said members whereby the applied heat is transferred to said fruit;

simultaneously with the heating of said fruit and the comminution thereof preventing air from contacting the fruit and by confining same within said housing member with the flight of said screw;

simultaneously with the comminution and heating of the fruit, progressively compressing same by constricting the space between said screw member and said housing member whereby the fruit is advanced by said screw member past a constricted portion of said space;

withdrawing oil from said housing member between said ends thereof, a fruit being extruded through said outlet end of said housing member, said screw member being of decreased diameter adjacent said outlet end to form a degassing zone; and evacuating vapor from said degassing zone.

* * * * *